US005236276A

United States Patent [19]

Chang et al.

[11] Patent Number: 5,236,276

[45] Date of Patent: Aug. 17, 1993

[54] CONSTRUCTION METHOD OF COMPOUND ASPHALT NET WITH FLAME TREATMENT

[76] Inventors: Chung-Hsiung Chang; Po-Hsing Chang, both of 2nd Floor, 9-1, Lane 161, Hsing An Road, Sec. 1, Taichung, Taiwan

[21] Appl. No.: 746,758

[22] Filed: Aug. 19, 1991

[51] Int. Cl.[5] ..... E01C 23/14

[52] U.S. Cl. ..... 404/79; 404/95; 404/107; 52/169.14; 52/514

[58] Field of Search ..... 404/71, 79, 82, 95, 404/107; 52/169.14, 514

[56] References Cited

U.S. PATENT DOCUMENTS 4,561,800 12/1985 Hatakenaka et al. ..... 404/79

4,929,120 5/1990 Wiley et al. ..... 404/79

*Primary Examiner*—William P. Neuder

[57] ABSTRACT

A method for applying an asphalt layer on a construction surface comprises the steps of placing an asphalt lattice having an admixture of fibrous and particulate matter onto the construction surface, and heating the lattice with a flame so as to melt the asphalt mixture causing it to flow over the surface and fill any depressions and cracks thereon. The asphalt layer thus formed is in intimate contact with the surface and can be used as waterproofing or as a primer layer for further applications of asphalt.

1 Claim, No Drawings

CONSTRUCTION METHOD OF COMPOUND ASPHALT NET WITH FLAME TREATMENT

BACKGROUND OF THE PRESENT INVENTION

The present invention relates to a process for applying a layer of asphalt onto a construction surface, and more particularly to a process for applying an asphalt layer onto a construction surface using a novel asphalt lattice having an admixture of fibers and particulate matter.

The asphalt net is melted by a flame onto the work surface so as to fill depressions or cracks thereon. This layer of asphalt, which is in intimate contact with the surface can function independently as a waterproofing layer or serve as a primer layer for the further application of a thick layer of asphalt as in road work.

SUMMARY OF THE PRESENT INVENTION

In accordance with the present invention, a process for applying a layer of asphalt onto a construction surface comprises an initial step of placing an asphalt lattice, which is formed from asphalt with an admixture of fibrous and particulate matter adhering to a net, onto the construction surface.

The lattice is then fused with a flame so that the liquid asphalt along with the admixed materials flows over the construction surface to fill any depressions and cracks thereon and adhere intimately with the surface upon cooling.

It is thus a main object of the present invention to provide a method of applying an asphalt layer onto a construction surface for use as a protective layer or as a pre-cursor for further layers of asphalt.

DETAILED DESCRIPTION OF THE PREFERRED EMBODIMENT

The asphalt lattice used in the asphalt application method of the present invention is produced by first dipping a relatively narrow mesh net made from a temperature resistant material into a cauldron of molten asphalt at a temperature of about 200° C. The asphalt permeated net is then removed and placed in a container having asbestos and linen fibers and aluminum powder so as to coat the net with the materials. The net is subsequently dipped into a second caldron having asphalt at a lower temperature of about 100° C. and then re-mixed with the container having the fibers and particulate matter. The process of dipping the net alternately into the second caldron and container of additives is repeated until a sufficient thickness of asphalt mixture is built up on the net. It should be noted that the fibrous material in the mixing container must be loose enough so as to readily absorb the liquid asphalt.

The asphalt lattice is applied onto a surface such as a cement floor or road by placing the lattice sheet thereagainst and blowing the lattice with a flame torch. The heat from the torch quickly fuses the asphalt mixture of the lattice and penetrates to the underlying surface through the apertures of the lattice so as to dissipate any residual water on the surface. The molten asphalt fills any cracks, crevices, or depressions in the surface and provides an even asphalt surface admixed with the fibers and particulate matter from the lattice which is intimately in contact with the underlying surface. This process can be repeated as many times as necessary over the first asphalt layer so as to acquire a desired thickness. Alternatively, a thick strata of asphalt can be applied over the precursor layer in the conventional manner.

The asphalt lattice is also readily adaptable for use on vertical surfaces wherein a large proportion of particulate matter such as sand is included in the mixture for better results. It is best to flame the lower portions of lattice during fusing before the upper portions thereof so as to prevent excessive run of the viscous asphalt.

The exact spirit and scope of the present invention should be determined not from the above but from the appended claim.

I claim:

1. A method of applying an asphalt layer to a horizontal or vertical construction surface by use of an asphalt lattice intermixed with fibrous and particulate matter in combination with a flamethrower comprising the following steps:

covering said construction surface with said asphalt lattice;

applying heat to said asphalt lattice with said flamethrower, in order to clean, dry and heat said working area so that the asphalt contained in said asphalt lattice can flow and disperse into cracks or depressions in said construction surface; and continuously applying heat to said asphalt lattice until said asphalt lattice becomes an uninterupted layer of asphalt and fiberous and particulate matter that is spread over and intimately in contact with said construction surface.

* * * * *